US005765404A

United States Patent [19]

Fanson et al.

[11] Patent Number: 5,765,404

[45] Date of Patent: Jun. 16, 1998

[54] BALANCE RING ATTACHMENT IN AN AUTOMATIC WASHER

[75] Inventors: Richard L. Fanson, St. Joseph; James W. Titus, Coloma, both of Mich.

[73] Assignee: Whirlpool Corporation, Benton Harbor, Mich.

[21] Appl. No.: 734,434

[22] Filed: Oct. 16, 1996

Related U.S. Application Data

[60] Provisional application No. 60/006,926 Nov. 17, 1995.

[51] Int. Cl. [6] ..... D06F 37/24

[52] U.S. Cl. ..... 68/23.2; 74/573 R

[58] Field of Search ..... 68/23.2; 210/144, 210/363, 364; 494/82; 73/573 R, 573 F

[56] References Cited

U.S. PATENT DOCUMENTS

| | | | |
|---|---|---|---|
| 3,610,069 | 10/1971 | Tanner | 74/573 |
| 4,044,626 | 8/1977 | Hayashi et al. | 74/573 |
| 4,646,545 | 3/1987 | Fanson et al. | 68/23.2 |
| 4,656,847 | 4/1987 | Bean et al. | 68/23.2 |
| 4,711,105 | 12/1987 | Oida et al. | 68/23.2 |
| 4,835,994 | 6/1989 | Ishida et al. | 68/174 |

*Primary Examiner*—Philip R. Coe
*Attorney, Agent, or Firm*—Thomas A. Schwyn; Joel M. Van Winkle; Robert O. Rice

[57] ABSTRACT

A balancing ring attachment system for an automatic washer including a wash basket having an annular top edge defining a circular opening at a top end thereof. An inwardly projecting annular ledge surface is formed into the wash basket below the top edge. A plurality of slots are provided on the wash basket between the ledge and the top edge. A balancing ring, sized to fit within the inner diameter of the wash basket, rests on the annular ledge and a plurality of resilient hooks outwardly extending from the balancing ring snap fit into the slots provided on the basket thereby securing the ring to the basket. Inset portions are provided in the ring behind each of the outwardly extending tabs while the basket further includes a plurality of bumps formed into the top edge of the wash basket wherein the bumps are formed as pairs along the top edge and define the location of the slots. During assembly, the bumps are received into the inset portion provided on the ring thereby controlling alignment and preventing missassembly. A plurality of flexible fingers are molded downwardly extending from the balancing ring wherein the fingers resiliently engage the annular ledge such that the fingers deflect and bias the balancing ring upwardly.

25 Claims, 3 Drawing Sheets

BALANCE RING ATTACHMENT IN AN AUTOMATIC WASHER

This application claims the benefit of U.S. Provisional Application No. 60/006,926 filed on Nov. 17, 1995.

BACKGROUND OF THE INVENTION

The present invention relates to washing machines, and more particularly, to an improved means for attaching a balance ring to an automatic washer basket.

It is a common practice in an automatic washer to provide a balancing ring around the top periphery of the wash basket to stabilize the basket as it rotates during the high speed spin mode.

The wash basket is spun with the clothes load during spin operations, and it is important that the balancing ring be securely attached to the basket so that it does not work loose during such operation. Ideally, the balancing ring should be configured such that it may be easily attached to the basket to facilitate assembly and reduce the cost to manufacture.

U.S. Pat. No. 4,646,545 discloses a balancing ring attachment system of an automatic washer. Mating ramp surfaces are provided on the basket and ring wherein attachment occurs when the ring is placed about the basket and rotated relative to the basket.

U.S. Pat. No. 4,656,847 discloses a balancing ring attachment system for an automatic washer. The ring is provided with a bottom wall having a channel therein which receives the edge of the basket opening. A plurality of spring clips having inwardly facing tangs are locked into the channel, thereby securing the ring to the basket.

U.S. Pat. No. 3,462,198 discloses a balancing ring which may be used in connection with an automatic washer or other rotating mechanisms. The balance ring is secured to the outer surface of the spin basket by means of inwardly extending headed projections which are pressed into and locked with apertures provided on the spin basket. At least a portion of the balancing ring may be displaced radially in response to the spinning of the basket.

U.S. Pat. No. 4,433,592 discloses a balance ring which contains both a low viscosity fluid and a plurality of spherical weights to effect balancing during spin. The balancing ring and the spin basket have cooperating flanges and are secured together by means of screws through the flanges.

U.S. Pat. No. 4,388,841 discloses a universal balancing member which comprises a hollow, annular tube member which is secured to the spin basket by means of a plurality of clip members. Each of the clip members extend around the outer surface of the balancing tube and have an outwardly extending head portion which snaps through a cooperating hole in the upper basket periphery.

In all of the prior art disclosures described above, the balance ring is secured to the basket by welding or by the use of a plurality of fasteners or by relatively complicated and time consuming manual assembly methods. It would be an improvement in the art, therefore, to develop a balance ring attachment system which requires no additional fasteners and can be secured to a basket by a simple uni-directional motion such that assembly difficulty is minimized.

SUMMARY OF THE INVENTION

The present invention provides a novel attachment means for a balancing ring for an automatic washer. Accordingly, it is an object of the present invention to provide an attachment means which allows a balancing ring to be attached to the basket without the need for separate fasteners.

Another object is to provide a balancing ring which may be assembled to the inner surface of the upper periphery of the wash basket using a simple, unidirectional, top-down motion.

Another object of the present invention is to provide an attachment means which allows a balancing ring to be secured to a wash basket wherein biasing means are provided for accommodating part tolerance.

Still another object is to provide a balancing ring which includes features to prevent out-of-roundness from occurring during high speed basket spin.

According to the present invention, the foregoing and other objects are attained by a balancing ring attachment system for an automatic washer including a wash basket having an annular top edge defining a circular opening at a top end thereof An inwardly projecting annular ledge surface is formed into the wash basket below the top edge. A plurality of slots are provided on the wash basket between the ledge and the top edge. A balancing ring, sized to fit within the inner diameter of the wash basket, rests on the annular ledge and a plurality of resilient hooks outwardly extending from the balancing ring snap fit into the slots provided on the basket thereby securing the ring to the basket. Inset portions are provided in the ring behind each of the outwardly extending tabs while the basket further includes a plurality of bumps or indent slots formed into the top edge of the wash basket wherein the bumps are formed as pairs along the top edge and define the location of the slots. During assembly, the bumps are received into the inset portion provided on the ring thereby controlling alignment and preventing misassembly. A plurality of flexible fingers are molded downwardly extending from the balancing ring wherein the fingers resiliently engage the annular ledge such that the fingers deflect and bias the balancing ring upwardly.

DESCRIPTION OF THE PREFERRED EMBODIMENT

Figure 1:
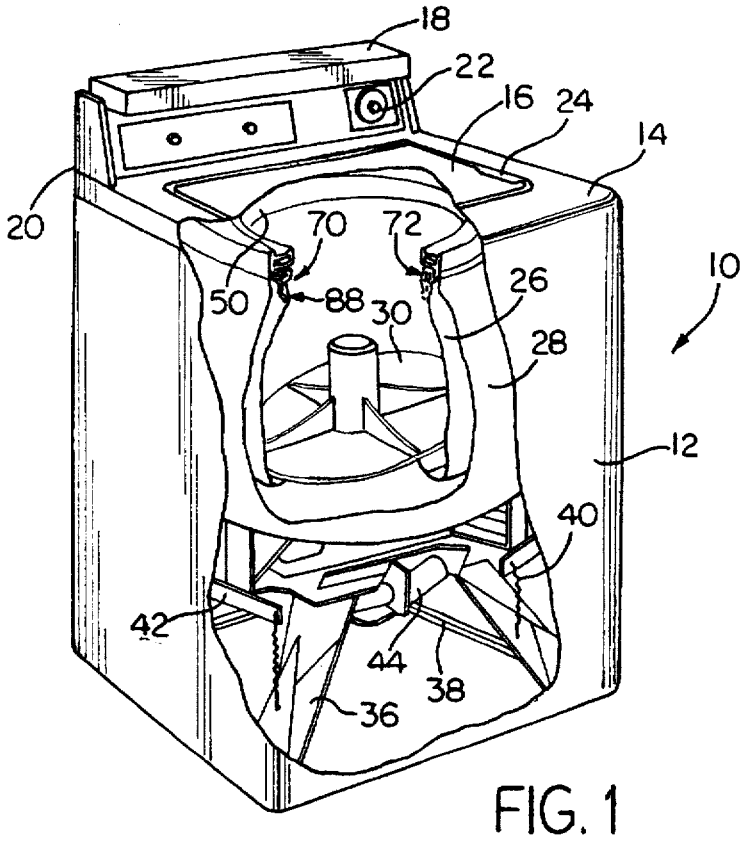
FIG. 1 is a perspective view of an automatic washer embodying a balancing ring and wash basket according to the principles of the present invention.

In FIG. 1, there is illustrated an automatic washing machine generally at 10 having an exterior cabinet 12 with a top panel 14 and an openable lid 16 forming a portion of the top surface. A control console 18 is positioned at a rear edge 20 of the top panel 14 and has on it a plurality of controls 22 for presetting the operation of the washer to operate through a series of washing, rinsing and drying steps.

Accessible through an opening 24 covered by the lid 16 is a perforate wash basket 26 concentrically mounted within an imperforate wash tub 28. Mounted within the lower portion of the wash basket 26 is a bottom plate 30 capable of being wobbled to agitate clothes.

The wash tub assembly is carried on supporting legs 36 which are connected to a washer frame 38 interior of the cabinet 12. Shock and vibration absorbing means 40 generally comprising springs 41 are attached between the legs 36 and a plurality of brackets 42 secured to the tub assembly. The bottom plate 30 may be selectively wobbled independently or rotated with the wash basket 26 by means of an electric motor 44.

Figure 2:
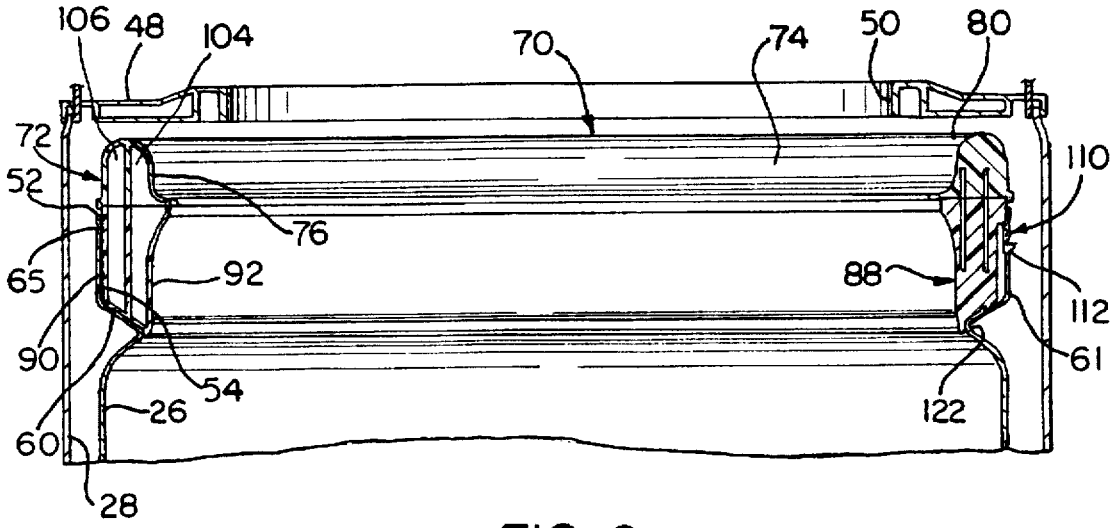
FIG. 2 is a partial side sectional view through the interior of the washer showing the balancing ring.

The interior of the wash basket 26 is shown in greater detail in FIG. 2 which is a cross-sectional view of the upper portion of the wash basket 26. The wash tub 28 has an attached top ring 48 with an opening 50 therein providing access to the interior of the wash basket 26. The wash basket 26 has an annular top edge 52 forming a substantially circular opening 54 which is approximately equal in diameter to the internal diameter of the wash basket 26 itself.

In FIGS. 3*a*, 3*b*, 4*a* and 4*b*, the upper portion of the wash basket 26 is shown in greater detail wherein it is seen that the basket 26 includes an inwardly projecting annular ledge 60 formed into the basket below the top edge 52 of the basket 26. The annular ledge 60 includes a downwardly ramped surface 61. The inner diameter of the annular ledge 60 is substantially less than the inner diameter of the basket and the basket is fabricated such that the inner diameter of the ledge 60 may be controlled within a relatively tight tolerance.

A plurality of circumferentially spaced slots 62 are provided in the basket between the top edge 52 and the ledge 60. Immediately above each of the slots 62 is an indented portion 64 wherein the wash basket wall is deflected inwardly. The indented portions 64 reduce excessive porcelain build-up above the slots 62 when the basket is coated with porcelain. A plurality of pairs of indent slots or gusset type bumps 66, corresponding with each of the slots 62, are formed into the basket 26, marking or identifying the location of the slots 62. The gusset bumps 66 are located in the basket 26 above the side edges of the slots 62. The basket further includes an inwardly projecting, annular rib 65, disposed between the slots 62 and the top edge 52 of the basket 26.

Figure 3A:
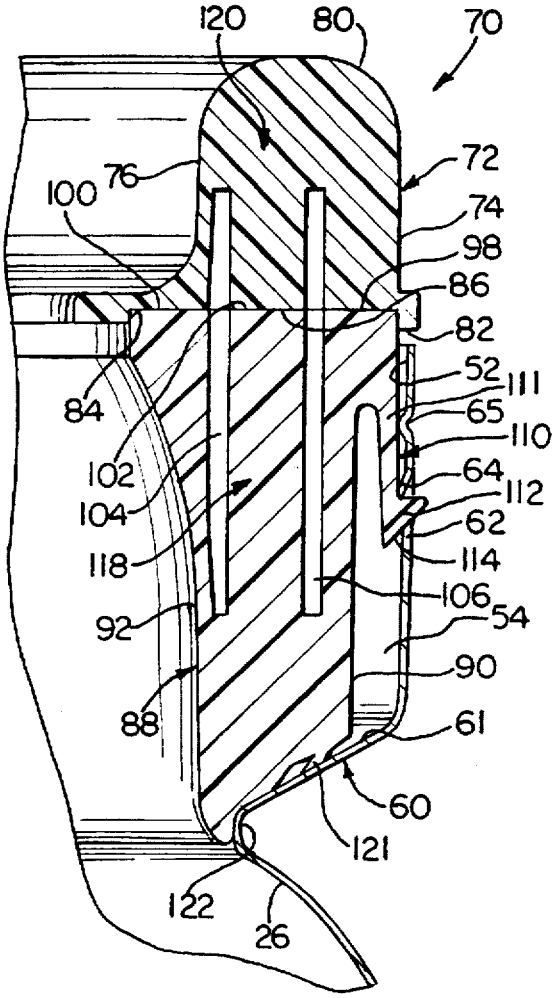
FIG. 3*a* is an enlarged partial side sectional view of the left hand side of the installed balancing ring as seen in FIG. 2.
Figure 3B:
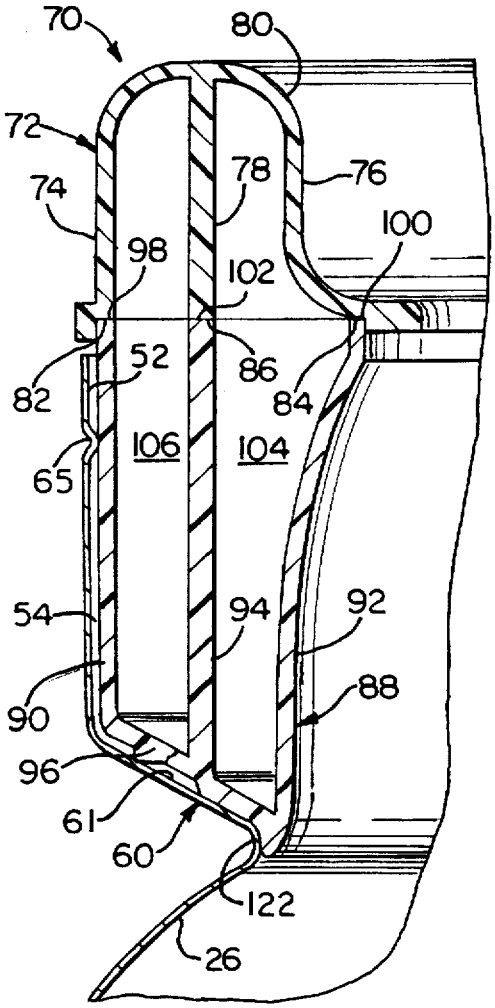
FIG. 3*b* is an enlarged partial side sectional view of the right hand side of the installed balancing ring as seen in FIG. 2.
Figure 4A:
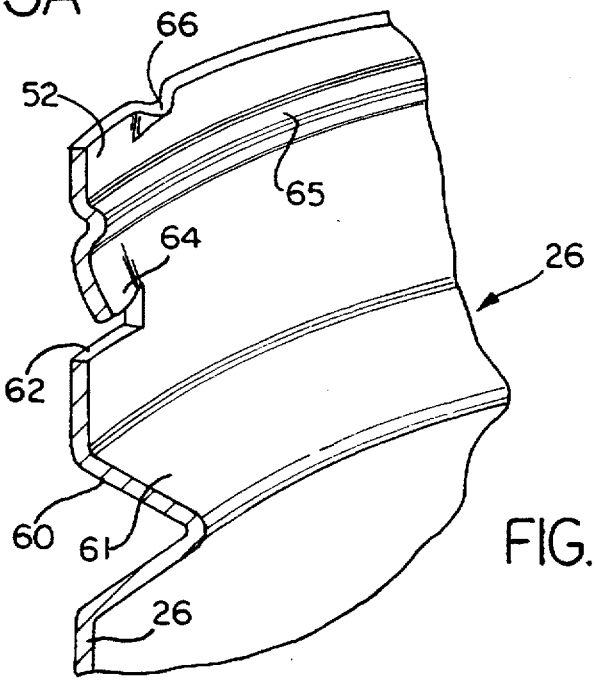
FIG. 4*a* is a partial, sectional, perspective view of the wash basket.
Figure 4B:
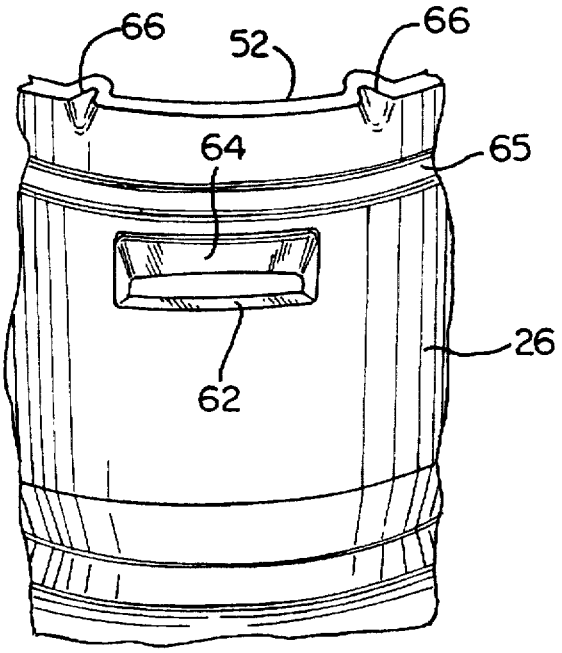
FIG. 4*b* is a partial, perspective side view of the wash basket.
Figure 5:
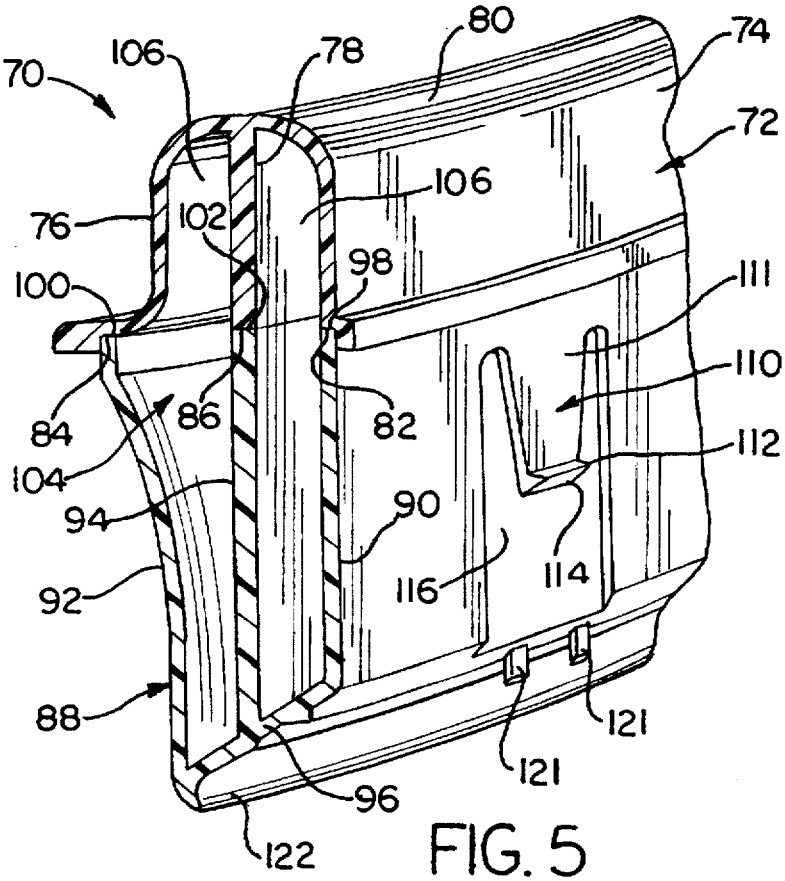
FIG. 5 is a partial, sectional, perspective view of the balancing ring.

As shown in FIGS. 3*a*, 3*b* and 5, a balancing ring or ring member 70 is sized to fit within the wash basket opening 54 and seat on the annular ledge 60 formed into the basket 26. The balancing ring 70 has an upper member 72 with an outer annular wall 74, an inner annular wall 76 and an intermediate annular wall 78, disposed between the outer and inner walls 74 76. The outer annular wall, inner annular wall and intermediate annular wall 74 76 78 have bottom edges 82 84 86, respectively, and are connected along a top edge by a curved top wall 80.

The ring member also has a bottom member 88 with an outer annular wall 90, an inner annular wall 92 and an intermediate annular wall 94. The outer, inner and intermediate annular walls 90 92 94 are connected along their bottom edges by an angled bottom support wall 96 which extends downwardly and inwardly from the bottom edge of the outer annular wall 90 toward the bottom edge of the inner annular wall 92. The outer, inner and intermediate annular walls 90 92 94 have top edges 98 100 and 102, respectively. These top edges 98 100 102 are configured to mate with the corresponding bottom edges 82 84 86 of the upper member 72, such that the ring 70 forms two concentric annular chambers 104 and 106.

The top and bottom members 72 and 88 are preferably formed of a molded thermoplastic material and can be permanently joined together such as by welding using a hot plate technique. As contemplated by the inventors, the bottom member 88 may be partially filled with water prior to joining the bottom member 88 to the upper member 72. In this fashion, the annular chambers 104 and 106 are filled with the desired quantity of balancing fluid.

Extending outwardly from the outer annular wall 90 of the bottom member 88 are a plurality of circumferentially spaced snap hooks 110. Each snap hook 110 includes a base portion 111 joined with the annular wall 90 and a barbed end portion 112 having ramped surface 114. The snap hooks 110 extend away from the outer annular wall 90 at a relatively small acute angle, preferably between 1°14 5°, resulting in the barbed end portions 112 being disposed a predetermined distance outwardly from the outer annular wall 90. An inset area portion 116 is provided in the outer annular wall 90 directly behind each snap hook 110. The inset area 116 extends from the base portion 111 of the hook 110 to the bottom edge of the outer annular wall 90 and has a width slightly greater than the facing snap hook 110. In this fashion, the barbed end portions 112 of the hook 110 may be resiliently deflected inwardly toward the outer annular wall 74 wherein the hook 110 is received in the inset portion 116 such that the outermost barbed portion of the hook may substantially, at least, align with the outer surface of the outer annular wall 74.

A plurality of interior baffles 118 are molded integrally with the bottom member 88 for impeding the flow of liquid within the annular chambers 104 and 106. The interior baffles 118 are best seen in FIG. 3A as the thickened portions of annular walls 90 92 94. The interior baffles 118 are positioned within the bottom member 88 such that one of the baffles 118 is disposed behind each of the hooks 110. In this manner, the outer wall 90 of the bottom member 88 is reinforced in the areas from which the hooks 110 extend. A plurality of corresponding internal baffles 120 are molded into the top member 72.

The interior baffles 118 and 120 permit the controlled flow of balancing fluid through the balancing ring during balanced and off-balanced conditions. The balancing fluid must be able to move quick enough within the ring to counterbalance an off-balance weight when the basket is accelerating to the top spin speed. For example, if a disproportionate amount of clothing is positioned on one side of the basket, this would result in an off-balance condition. The fluid within the ring would move to a position opposite the off-balance clothes load, thus counteracting the off-balancing condition. However, the balancing fluid must be prevented from moving around the balancing ring to create an off-balance condition when there is no off-balance weight. The internal baffles are used to prevent the unobstructed movement of liquid within the ring by permitting unobstructed fluid flow in the annular channels in areas between the baffles while retarding fluid flows through the baffles.

To assemble the balancing ring 70 onto the wash basket 26, the ring 70 is placed within the basket opening 54 with the retention hooks 110 above the slots 62 formed into the basket. The gusset bumps 66 visually assist in the aligning of the ring such that the hooks 110 are disposed over the slots 62. Moreover, for the balancing ring to fit down within the basket opening 54, the gusset bumps must be received in the side edge portions of the inset portion 116 of the outer wall 90. In this fashion, the gusset bumps control the ring orientation with regard to the basket and preclude misassembly.

Downwardly forcing the balance ring 70 into the basket opening 54 causes the top edge 52 of the basket to engage the ramped surface 114 of the hooks 110 such that the hooks 110 are resiliently deflected inwardly where they are received into the corresponding inset portions. As the ring 70 approaches the annular ledge 60, a plurality of resilient fingers 121, molded on the exterior surface of the bottom support wall 94, engage the downwardly ramped surface 61. The fingers 121 are deflected inwardly and exert an upward bias on the balance ring 70. Preferably one or more fingers downwardly extend from the bottom support wall beneath each of the retention hooks 110.

When the balancing ring 70 has been inserted into the basket opening 54 to a predetermined position, the barbed end portions 112 of the hooks 110 snap engage into the slots 62 formed into the basket walls, thereby securely positioning the balancing ring 70 within the basket opening 54. The indented portions of 64 of the basket 26 ensure a secure engagement between the hook 110 and the slots 62.

The balancing ring 70 has a bottom annular surface 122 having a diameter substantially corresponding in size to the inner diameter of the annular ledge 60. During the balancing ring fabrication, the diameter of the inner surface 122 is controlled to a relatively tight tolerance. In the secured or seated position, the bottom annular surface 122 of the ring is disposed immediately inwardly adjacent the inner diameter of the annular ledge 60. During high speed basket rotation, the interface between the annular surface 120 and the inner diameter of the annular ledge 60 maintain the roundness of the relatively compliant plastic balancing ring 70. Moreover, the outer annular wall 90 of the ring 70 is provided with a plurality of ramped projections 124 which engage the annular rib 65 for further precluding ring deformation during high speed basket spinning.

It can be seen, therefore, that the present invention provides a means for attaching the balancing ring 70 to the wash basket 26 which does not require the usage of additional fastener which would require additional fastening steps and manufacturing steps. Rather, a fastening means is provided which allows for a quick, efficient and secure attachment of the balancing ring to the wash basket. The balancing ring can be quickly assembled to the basket by a single downward motion. No rotation or special twisting of the balance ring is required for assembly. This simple top down motion is advantageous for ease of assembly.

Although the present invention has been described with reference to a specific embodiment, those of skill in the Art will recognize that changes may be made thereto without departing from the scope and spirit of the invention as set forth in the appended claims.

We claim:

1. An improved rotatable wash basket and a balancing ring assembly for an automatic washing machine, the assembly comprising:

a wash basket having an annular top edge defining a circular opening at a top end thereof;

a plurality of slots provided in said wash basket near the top edge;

a balancing ring sized to fit within the inner diameter of said wash basket;

a plurality of resilient hooks provided on and outwardly extending from the balancing ring for snap fitting into said slots provided in said basket.

2. The assembly according to claim 1, wherein an inwardly projecting annular ledge surface is formed into said wash basket below said top edge, the slots are positioned between said ledge and said top edge, and the balancing ring rests on said annular ledge.

3. The assembly according to claim 2, further comprising a plurality of flexible fingers downwardly extending from said balancing ring, said fingers resiliently engaging said annular ledge such that said fingers deflect and bias said balancing ring upwardly.

4. The assembly according to claim 2, wherein:

said balancing ring includes an annular surface disposed along the lower portion of the balancing ring; and said inwardly projecting annular ledge surface forms a controlled inner diameter surface, wherein when said balancing ring is assembled to said wash basket, said annular surface and said controlled inner diameter surface mate such that the balancing ring is radially constrained during high speed spinning.

5. The assembly according to claim 1, wherein said basket further includes inwardly extending indentations disposed directly above said slots.

6. The assembly according to claim 1, wherein said slots include side edges, and the balancing ring assembly further comprising a plurality of bumps formed in said wash basket and disposed above said side edges of said slots, wherein said bumps form pairs above said side edges of said slots.

7. The assembly according to claim 6, wherein said balancing ring includes an inset portion disposed behind each of said resilient hooks, and said bumps are received into said inset portion when said balancing ring is assembled to said wash basket to align the resilient hooks with the slots.

8. The assembly according to claim 1, further comprising an inwardly extending annular rib formed in said basket between said slots and said top edge wherein said annular rib engages the outer surface of the balancing ring.

9. The assembly according to claim 1, wherein the balancing ring has a hollow interior defining at least one annular channel adapted to hold a balancing fluid, and a plurality of baffles are disposed within said annular channel to retard the movement of the balancing fluid through the annular channel.

10. The assembly according to claim 9, wherein said baffles are positioned within said balancing ring to support said resilient hooks.

11. A wash basket assembly comprising:

a wash basket having an annular top edge defining a circular opening at a top end thereof, said wash basket including:

an inwardly projecting annular ledge surface formed into said wash basket below said top edge, a plurality of slots provided on said wash basket between said ledge and said top edge, and a plurality of gusset bumps; and a balancing ring sized to fit within the inner diameter of said wash basket and rest on said annular ledge, said balancing ring including:

a plurality of resilient hooks outwardly extending from the balancing ring for snap fitting into said slots provided on said basket, and a plurality of inset portions, wherein said gusset bumps are received into said inset portions when said balancing ring is assembled to said wash basket such that said balancing ring is correctly aligned with said wash basket.

12. The wash basket assembly according to claim 11, wherein said basket further includes inwardly extending indentations disposed directly above said slots.

13. The wash basket assembly according to claim 11, further comprising an inwardly extending annular rib formed into said basket between said ledge and said top edge wherein said annular rib engages the outer surface of the balancing ring.

14. The wash basket assembly according to claim 11, further comprising a plurality of flexible fingers downwardly extending from said balancing ring, said fingers resiliently engaging said annular ledge such that said fingers deflect and bias said balancing ring upwardly.

15. The wash basket assembly according to claim 11, wherein:

said balancing ring includes an annular surface disposed along the lower portion of the balancing ring; and said inwardly projecting annular ledge surface forms a controlled inner diameter surface, wherein when said balancing ring is assembled to said wash basket, said annular surface and said controlled inner diameter surface mate such that the balancing ring is radially constrained during high speed spinning.

16. The assembly according to claim 11, wherein the balancing ring has a hollow interior defining at least one annular channel adapted to hold a balancing fluid, and a plurality of baffles are disposed within said annular channel to retard the movement of the balancing fluid through the annular channel.

17. An automatic washer comprising:

a wash basket with a longitudinal axis having a circumferential wall, which terminates in an annular top edge to define an opening, and at least one slot is provided in the circumferential wall;

a balancing ring having at least one resilient hook, which extends from the balancing ring substantially parallel to the longitudinal axis of the wash basket; and the at least one resilient hook is received within the at least one slot to mount the balancing ring to the wash basket when the balancing ring is moved substantially unidirectionally along the longitudinal axis of the wash basket toward the wash basket.

18. An automatic washer according to claim 17, wherein the wash basket has an indentation that defines a portion of the slot and which engages the at least one resilient hook when the balancing ring is mounted to the wash basket.

19. An automatic washer according to claim 17, wherein the wash basket has an inwardly projecting annular ledge and a portion of the balancing ring is received within the opening and supported by the annular ledge when the balancing ring is mounted to the wash basket.

20. An automatic washer according to claim 19, wherein the balancing ring has multiple resilient fingers extending therefrom and in abutment with the annular ledge to urge the balancing ring away from the annular ledge.

21. An automatic washer according to claim 20, wherein the circumferential wall has an annular rib abutting the balancing ring.

22. An automatic washer according to claim 21, wherein the at least one baffle is a thickened portion of the balancing ring.

23. An automatic washer according to claim 20, wherein the at least one baffle is positioned within the annular channel in radial alignment with the at least one resilient hook.

24. An automatic washer according to claim 20, wherein an annular wall is positioned within the annular channel to divide the annular channel into first and second portions.

25. An automatic washer according to claim 17, wherein the balancing ring has a hollow interior defining at least one annular channel adapted to hold a balancing fluid, and at least one baffle is disposed within said annular channel to retard the movement of the balancing fluid through the annular channel.

* * * * *